US006644377B1

(12) United States Patent
Lewis

(10) Patent No.: US 6,644,377 B1
(45) Date of Patent: Nov. 11, 2003

(54) OVERLAPPING BLIND APPARATUS

(76) Inventor: Phillip Lewis, 3230 Maple Ave., #486, Dallas, TX (US) 75201

( * ) Notice: Subject to any disclaimer, the term of this patent is extended or adjusted under 35 U.S.C. 154(b) by 0 days.

(21) Appl. No.: 09/855,559

(22) Filed: May 16, 2001

Related U.S. Application Data

(60) Provisional application No. 60/205,471, filed on May 19, 2000.

(51) Int. Cl.[7] ..... E06B 9/30

(52) U.S. Cl. ..... 160/176.1 R; 160/115; 160/176.1 V

(58) Field of Search ..... 160/115, 116, 160/176.1 R, 178.3

(56) References Cited

U.S. PATENT DOCUMENTS 2,117,953 A * 5/1938 Grau
2,231,778 A * 2/1941 Swanson
2,757,727 A * 8/1956 Findell
4,462,452 A * 7/1984 Oskam
4,593,738 A * 6/1986 Chi Yu
4,628,979 A * 12/1986 Hsu
4,651,794 A * 3/1987 Bytheway, Jr.
4,884,612 A * 12/1989 Schnebly et al.
4,951,729 A * 8/1990 Chi Yu
5,232,037 A * 8/1993 Fraser
5,285,838 A * 2/1994 Rapp et al.
5,558,146 A * 9/1996 Abe

* cited by examiner

*Primary Examiner*—Blair M. Johnson
(74) *Attorney, Agent, or Firm*—Krieg DeVault Lundy, LLP

(57) ABSTRACT

The overlapping blind apparatus comprises first and second ladder strings which are biased by a top pulley in either clockwise or counter-clockwise directions. Bridging strings are provided in spaced, parallel relation between the first and second ladder strings. A first slat and a second slat are joined at one end to form a hinged set of overlapping blinds. Multiple sets of overlapping blinds are sized to cover a window opening. Louver strings are attached at one end to the center of the first slats, and at the opposite end to the second ladder string. When the top pulley is rotated counter-clockwise, the first slats are biased open. When the blinds are fully extended, the first slats rest against the bottom of the next adjacent lower slat, providing an overlap, which effectively blocks light leakage through the slats. When the top pulley is rotated clockwise, the upper and lower slats tilt, yet remain in a substantially closed, parallel alignment. A central lifting string is provided to raise or lower the overlapping blinds. Indicia may be placed on the upper and lower slats. The overlapping blind apparatus may be selectively positioned either horizontally or vertically about a window.

19 Claims, 7 Drawing Sheets

OVERLAPPING BLIND APPARATUS

This application claims the benefit of Provisional Application No. 60/205,471, filed May 19, 2000.

BACKGROUND OF THE INVENTION

Window treatment, namely the art of decorating the interior of a window, has been subject to fashion change over the years. Earlier in the century spring-loaded pull up shades and two-inch blinds called venetian blinds were in vogue. In the sixties, the use of drapes rather than blinds or shades was commonly practiced by interior decorators of that time. In the early seventies, Roman shades, which were rolled up from the bottom toward the top by a drawstring, were considered chic. In the late seventies mini-blinds, i.e. those of one-inch depth came into fashion as the preferred window treatment.

Today, the mini-blind continues to be fashionable along with the pleated shade. Pleated shades are constructed of horizontal pleats of a single piece of fabric. They operate much like the shades of old in that viewing can only take place when the shades are drawn open, i.e. raised upwardly from the bottom of the window. Blinds on the other hand offer viewing capability without the necessity of raising them. The blind permits the slats to be oriented parallel to one another, thereby letting light in from the window.

Both children and infirm individuals can operate mini-blinds to change the condition from light emitting to light prevention with minimal effort, in contrast to the operation of a shade or pleated shade.

Examples of blind systems and shades are found in a number of U.S. Patents. U.S. Pat. No. 2,231,778 to Swanson discloses a typical traditional venetian blind. This blind uses tape ladders to hold and align the slats. The system has a mechanism for turning a headpiece that raises and lowers the tapes, thereby opening and closing the slats. Traditionally, the slats were wide and the system was heavy.

U.S. Pat. No. 2,512,594 to Burnes discloses a vertical form of blinds. Burnes states that this design prevents the buildup of dust on the blinds and makes them easier to operate than the horizontal blinds. One change in this design is that the vertical slats overlap when closed. When open, they look like ordinary vertical blinds. When closed, the overlapping slats block all light from entering the room, making them more efficient than the standard horizontal blinds. The overlap is achieved by making the slats wider than the space between adjacent slats. Thus, when closed, the end of one vertical slat overlaps the adjacent slat.

U.S. Pat. No. 2,247,260 to Stone discloses a typical pleated shade. Here, a solid shade is positioned between a head rail and a bottom rail. The bottom rail can be lifted to open the shade. Unlike blinds, however, there are no slats to open when the shade is closed.

Although shades and blinds have worked well over the years, there have been attempts to improve their design. Most blinds leak light, either through the gaps between the slats, or through slots in the slats that the rope ladders pass through. One innovative design is found in U.S. Pat. No. 4,076,068 to Archer et al. In this design, the blinds are positioned between two panes of glass. Thus, the blinds are an integral part of the window itself. When the slats are closed, there are two lines of slats, spaced apart. This acts to reduce the amount of light passing through the blinds to a minimum. Unfortunately, because the blinds are installed within the window, maintenance is difficult. Moreover, changing the color or style of blinds is no easy task.

U.S. Pat. No. 3,851,699 to Shapiro teaches a system of vertical drapes that have "blind-like" characteristics. The drapes are an alternate set of panels. Light transmitting panels are interposed adjacent to light impeding panels. When the drapes are open, the light transmitting panels are aligned parallel to a light source, while the light impeding panels are orthogonal to the light transmitting panels. When closed, the light impeding panels fold over the light transmitting panels, thereby blocking out the light.

U.S. Pat. No. 2,757,727 issuing to Findell, discloses a system of curved slats. Each curved slat has two curved pieces that rest on a carrier. When open, the slats look like ordinary slats. When closed, the slats are open on one end. The tops of the lower slats contact the bottoms of the slats immediately above them. This produces a continuous overlapped row of slats that works to prevent light leakage between the slats. Although this system may be more effective at limiting light transmission, the system uses thick slats that limit light transmission when open, and are bulkier than a flat set of blinds when closed.

U.S. Pat. No. 4,628,979 issuing to Pei-Shun Hsu discloses a window blind having a plurality of horizontal slats that can be regulated to simulate a pleated window.

U.S. Pat. No. 4,651,794 to Bytheway Jr. attempts to solve the problem of light leakage by designing a set of blinds that when closed, take on the form of a pleated shade. This system uses a number of curved slats that are connected to two ladder systems. In this way, the slats alternate when the blind is closed, forming a series of "V" shaped panels. These panels take on the appearance of a pleated shade. This works because the rear end of one slat is rotated down to meet the rear end of the slat immediately below it, while the front end of the lower slat is lowered to meet the front end of the next lower slat that rises to meet it. The pattern is repeated for the entire length of the blind. The difficulty with this design is the complex system needed to move the slats in an alternate configuration such as (up, down, up, down, etc.) This not only increases costs, but also increases the likelihood of operating problems with the blinds over time.

U.S. Pat. No. 4,708,188 issuing to Bytheway Jr. discloses two pair of cable ladders, which move in opposite directions, to move alternate slats in opposite directions.

U.S. Pat. No. 5,558,146 issuing to Makio Abe discloses a blind having transparent base boards and graphic patterns to selectively block or reflect light.

SUMMARY OF THE INVENTION

The overlapping blind apparatus comprises first and second ladder strings which are biased by a first pulley rod in either clockwise or counter-clockwise directions. When the second ladder string is pulled up, the first ladder string is pulled down. Bridging strings are provided in spaced, parallel relation between the first and second ladder strings. A first slat and a second slat are joined at one end to form a hinged slat. Multiple sets of hinged slats are sized to cover a window opening. The slats may be vertically or horizontally aligned. First louver strings are attached to the center of each of the first slat portions, and to the second ladder string. When the first pulley is rotated counter-clockwise, the first slat portions are biased open while the second slat portions are biased away from the first slat portions, to form a V-slat configuration. When the blinds are fully extended, the first slat rests against the bottom of the next adjacent second slat, providing an overlap, which effectively blocks light leakage through the slats. When the first pulley rod is rotated clockwise, the first and second slats tilt, yet remain in a substantially closed, parallel alignment similar to existing mini-blinds. A central lifting string is provided to raise or lower the horizontal overlapping blinds. The central string does not hamper the operation of the horizontal overlapping blinds, because the first slats have an elongated aperture similar to the elongated aperture in the second slat, to allow the central draw string to pass therethrough. Indicia may be placed on the first and second slats. This invention may be adapted for either horizontal or vertical alignment of the blinds.

Objects and advantages of this invention will become apparent by reference to the following description and accompanying drawings.

Figure 1A:
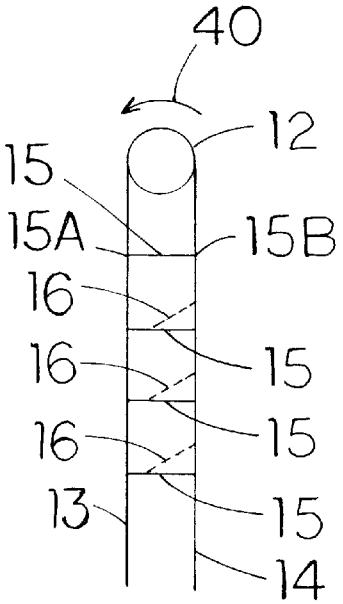
FIG. 1A is a side detail view of a portion of the horizontal overlapping blind apparatus, without the first and second blind slats in place, showing the spaced ladder strings in a substantially horizontal position.

The subject matter, which I regard as my invention, is particularly pointed out and distinctly claimed in the claims. The structure and operation of my invention, together with further objects and advantages, may be better understood from the following description given in connection with the accompanying drawings.

DETAILED DESCRIPTION OF THE INVENTION

The overlapping blind apparatus 10 shown in detail in FIG. 1A through FIG. 1C, FIG. 3A through FIG. 3C, and FIG. 5A through FIG. 5C, show the overlapping blind apparatus, when the first pulley rod 12 is rotated in a counter-clockwise position, as shown by arrow 40. The overlapping blind apparatus 10 shown in detail in FIGS. 2A through 2C, FIGS. 4A through 4C and FIGS. 6A through 6C show the overlapping blind apparatus, when the first pulley rod 12 is rotated in a clockwise position, as shown by arrow 41.

The overlapping blind apparatus 10 has a first pulley rod 12 that rotates in either clockwise or counter-clockwise directions. First and second ladder strings 13, 14 are biased by the first pulley rod 12, which is partially rotated to selectively raise or lower the ladder strings 13, 14.

When the first pulley rod 12 is horizontally rotated in a counter-clockwise position as shown by arrow 40, in FIGS. 1A through 1C, FIGS. 3A through 3C, and FIGS. 5A through 5C, the first ladder string 13 is lowered, as the second ladder string 14 is raised. There are at least two sets of first and second ladder stings 13, 14 positioned in spaced relation along the first pulley rod 12.

When the first pulley rod 12 is horizontally rotated in a clockwise position as shown by arrow 41 in FIGS. 2A through 2C, FIGS. 4A through 4C and FIGS. 6A through 6C, the first ladder string 13 is raised, as the second ladder string 14 is lowered.

Thus, the first pulley rod 12 of the overlapping blind apparatus 10 can be horizontally rotated either clockwise or counter-clockwise, to selectively raise or lower the first ladder string 13, while the second ladder string 14 moves in a direction opposite to the first ladder string 13.

A plurality of bridging strings 15 are each secured in a spaced parallel alignment between the first and second ladder strings 13, 14. The first end 15A of each bridging string 15 is secured to the first ladder string 13, while the second end 15B of each ladder string 15 is secured to the second ladder string 14. The bridging strings 15 are spaced substantially equally apart. In one embodiment, the distance between bridging strings 15 is selected to be from about three quarters of an inch to about four inches apart. Specifically, the width of each second slat 21 is more than about one-half the distance between the bridging strings 15.

Thus, when the first pulley rod 12 is horizontally rotated counter-clockwise in the direction shown by arrow 40, the first ladder string 13 is lowered, while the second ladder string 14 is raised. This tilts the bridging strings 15, as shown in FIGS. 1B and 1C, and in FIGS. 3B and 3C.

Figure 2A:
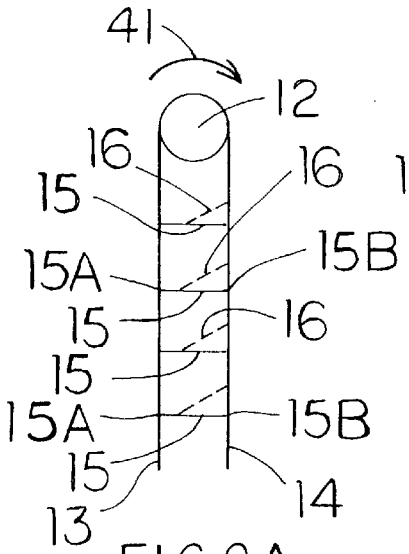
FIG. 2A is a side detail view of a portion of the horizontal overlapping blind apparatus, without the first and second blind slats in place, showing the spaced ladder strings in a substantially horizontal position.
Figure 2B:
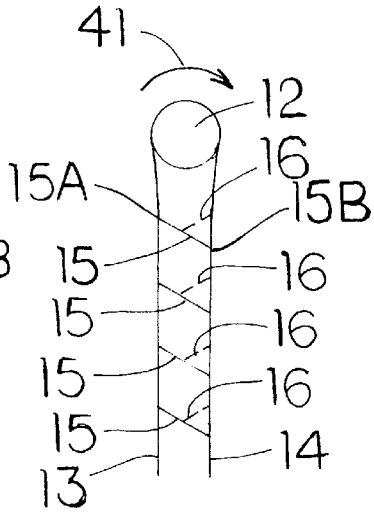
FIG. 2B is a side detail view of a portion of the horizontal overlapping blind apparatus, without the first and second blind slats in place, showing the first pulley rod partially rotated clockwise, with the first side of the spaced ladder strings inclined upward about 45 degrees.
Figure 2C:
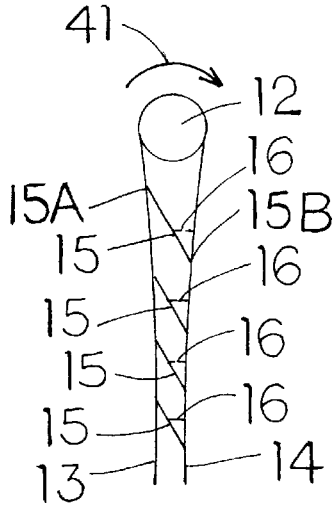
FIG. 2C is a side detail view of a portion of the horizontal overlapping blind apparatus, without the first and second blind slats in place, showing the first pulley rod further rotated clockwise, with the first side of the spaced ladder strings inclined upward about 75 degrees.

When the first pulley rod 12 is horizontally rotated clockwise, in the direction shown by arrow 41, the first ladder string 13 is raised, while the second ladder string 14 is lowered. This tilts the bridging strings 15, as shown in FIGS. 2B and 2C and in FIGS. 4B and 4C.

The louver strings 16 are attached to the second ladder string 14 in spaced relation. The louver strings 16 are attached at first end to the second ladder string 14 and at a second end to the outer surface of the first slat 20. Because the second end of the louver strings 16 are not attached to the first ladder string 13, the louver strings 16 are angled upward or downward only by actuation of the second ladder string 14.

Figure 1B:
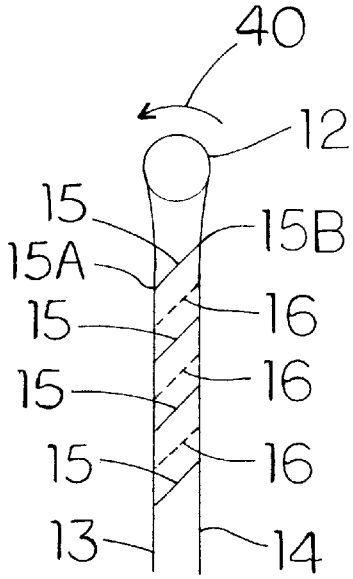
FIG. 1B is a side detail view of a portion of the horizontal overlapping blind apparatus, without the first and second blind slats in place, showing first pulley rod partially rotated counter-clockwise, with the first side of the spaced ladder strings inclined downward about 45 degrees.
Figure 1C:
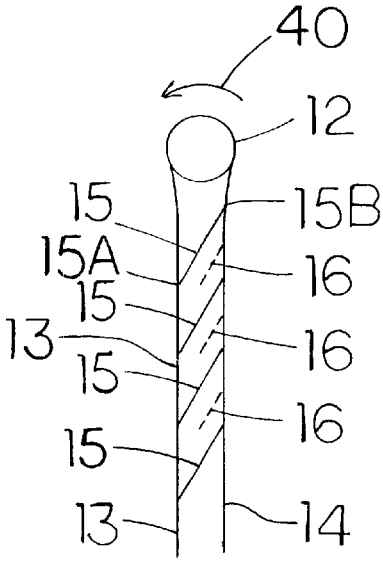
FIG. 1C is a side detail view of a portion of the horizontal overlapping blind apparatus, without the first and second blind slats in place, showing the first pulley further rotated counter-clockwise, with the first side of the spaced ladder strings inclined downward about 75 degrees.
Figure 3A:
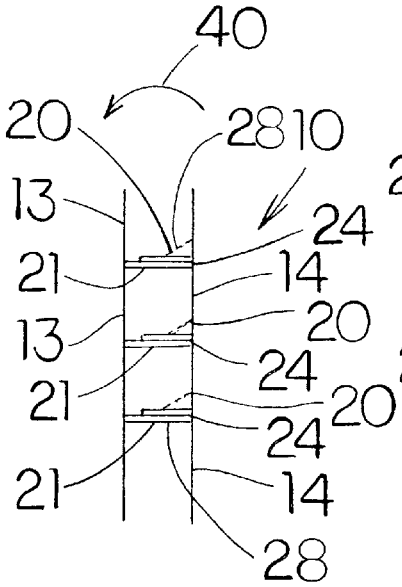
FIG. 3A is a partial detail view of a portion of the overlapping blind apparatus, with the blind slats in place, showing the overlapping blinds in a substantially closed, horizontal position, as shown in FIG. 1A
Figure 3B:
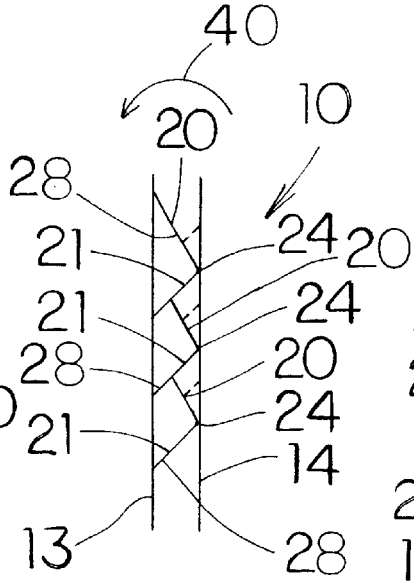
FIG. 3B is a partial detail view of a portion of the overlapping blind apparatus, with the blind slats in place, and with the first pulley rod partially rotated counter-clockwise, showing the ladder strings partially opened and positioned as shown in FIG. 1B.
Figure 3C:
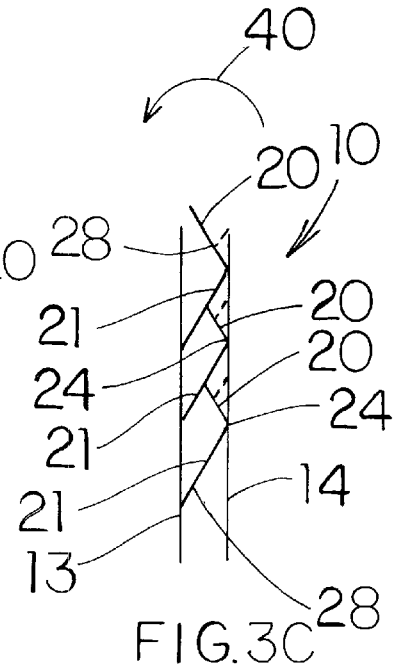
FIG. 3C is a partial detail view of a portion of the overlapping blind apparatus, with the blind slats substantially opened, and with the first pulley rod further rotated counter-clockwise, showing the ladder strings positioned as shown in FIG. 1C.

FIG. 3A, FIG. 3B and FIG. 3C show the same views as FIG. 1A, FIG. 1B and FIG. 1C, respectively, but with a first slat 20, and a second slat 21 in place between the first and second ladder strings 13, 14. In one embodiment, the first slat 20 is narrower in width than the second slat 21. One end 26 of each first slat 20 is pivotally secured by a hinge means 22 to an adjacent end 27 of a second slat 21, thereby forming a hinged end 24 therebetween. Multiple hinged sets of overlapping blinds 28 are used to form the overlapping blind apparatus 10 disclosed herein. The hinge means 22 of overlapping blinds 28 is positioned and secured adjacent to the second ladder string 14.

The hinge means 22 in one embodiment comprises an inline crease along the length of a single large slat that is folded over on itself along the crease to form a first slat portion 20 and a second slat portion 21. Other known means of hinging the first slat 20 to the second slat 21 may also be used. In other embodiments, the hinge means 22 comprises a flexible sheet material, such as fabric or film material, secured to adjacent first and second slats 20, 21 on their respective outer surfaces 48, 49 or inner surfaces 46, 47.

The first and second slats 20, 21 are preferably made of a material selected from: plastic, wood, fiberglass, fabric and/or metal.

Each first slat 20 is secured to the next adjacent louver string 16. Thus, when the first pulley rod 12 is partially, horizontally rotated counter-clockwise, as shown by arrow 40, each of the plurality of first slats 20 is raised by the respective plurality of louver strings 16. This causes each of the first slats 20 to pivot about the hinge means 22 at the hinged end 24 in relation to the second slat 21. While the first slat 20 is raised, the second slat 21 is lowered by the tilting bridging string 15, forming a V-shaped slat assembly. The slat assembly is inclined towards the first ladder string 13, as shown in FIGS. 3B and 3C and FIGS. 5B and 5C.

However, when the first pulley rod 12 is partially rotated clockwise, the first slat 20 remains in a closed position substantially parallel to the second slat 21, as the second slat 21 is inclined towards the second ladder string 14, as best shown in FIGS. 4B–4C and FIGS. 6B–6C. This is made possible because the louver string 16 and the second ladder string 14 are lowered together when the first pulley rod 12 is partially rotated clockwise. While the second ladder string 14 is lowered, the first ladder string 13 is raised by the clockwise movement of the first pulley rod 12, which in turn inclines the second slat 21 in a direction parallel to the position of the first slat 20.

Figure 5A:
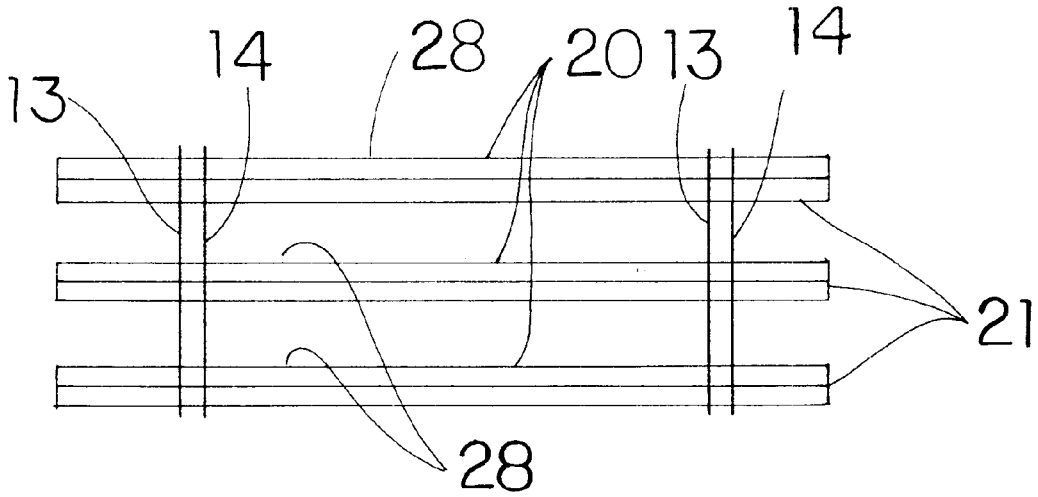
FIG. 5A is an elevational view of a portion of the horizontal overlapping blind apparatus, with the blind slats in place, showing the overlapping blinds in the closed, horizontal position shown in FIG. 3A.

With the overlapping blind apparatus 10 positioned as shown in FIG. 3A and FIG. 5A, the first slat 20 rests upon the second slat 21 of each blind set 28. In this position, the second slat 21 and first slat 20 are substantially parallel to each other, with each hinged set of overlapping blinds 10 in a substantially closed position 24. When the multiple blind sets 28 are positioned in this manner, they resemble regular mini-blinds and essentially allow the most light and view through the multiple blind sets 28.

Figure 5B:
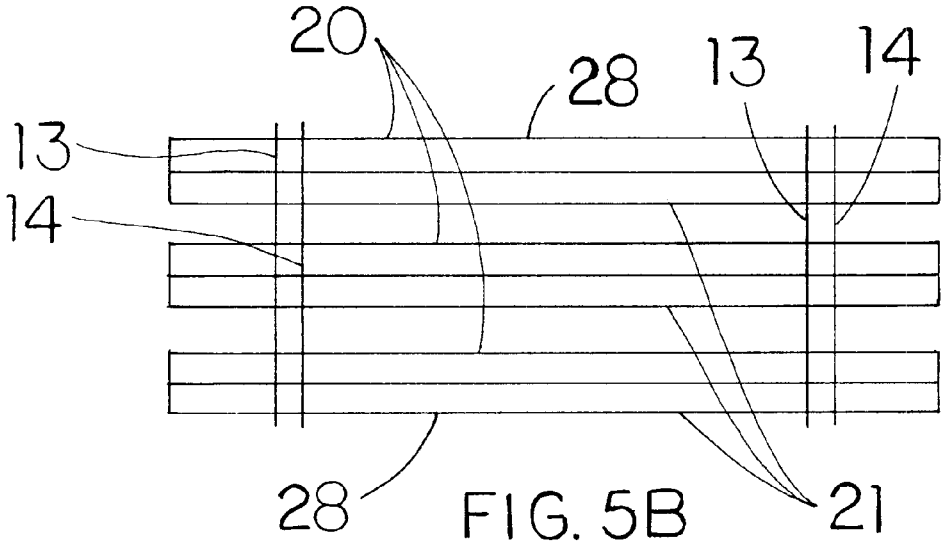
FIG. 5B is an elevational view of a portion of the horizontal overlapping blind apparatus, with the blind slats in place, and with the first pulley rod partially rotated counter-clockwise, showing the overlapping blinds partially opened in the position shown in FIG. 3B.
Figure 5C:
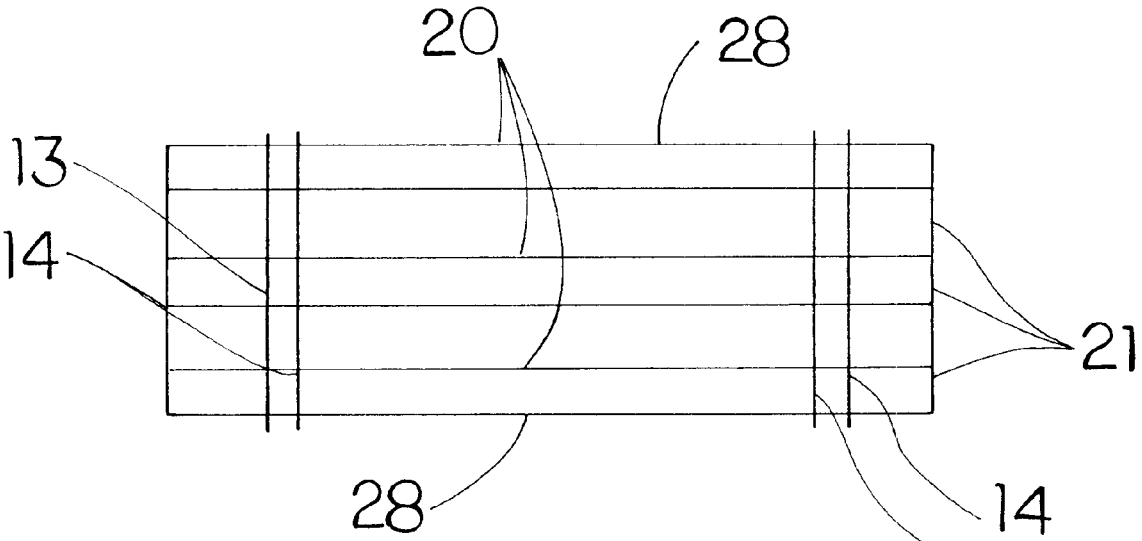
FIG. 5C is an elevational view of a portion of the horizontal overlapping blind apparatus, with the blind slats in place, and with the first pulley rod further rotated counter-clockwise, showing the overlapping blinds positioned in the fully open position shown in FIG. 3C.

When the first pulley rod 12 is partially moved counter-clockwise in the direction of arrow 40, the first and second slats 20, 21 are partially extended into an open position about the hinge means 22 at the hinged end 24, as shown in FIGS. 3B and 5B. When the first pulley rod 12 is further moved counter-clockwise in the direction of arrow 40, the first and second slats 20, 21 are further extended into an open position in a V-shape about the hinge means 22 at the hinged end 24, as shown in FIGS. 3C and 5C.

Figure 4A:
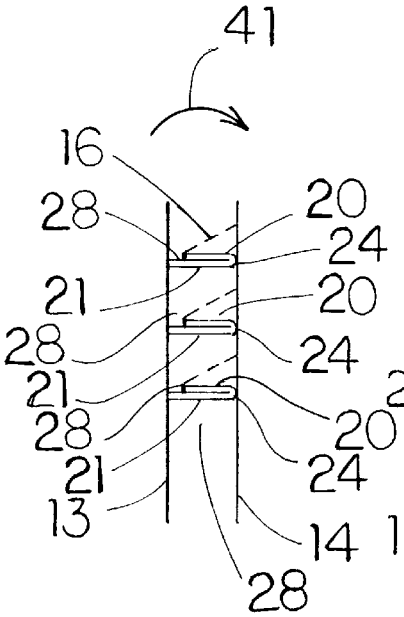
FIG. 4A is a partial detail view of a portion of the overlapping blind apparatus, with the blind slats in place, showing the overlapping blinds in a substantially closed, horizontal position, as shown in FIG. 2A.
Figure 4B:
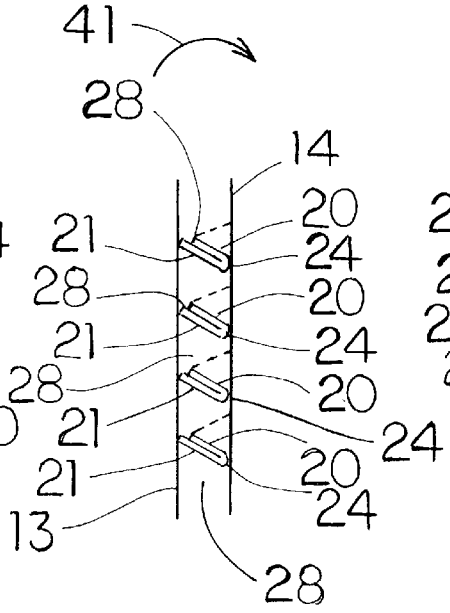
FIG. 4B is a partial detail view of a portion of the overlapping blind apparatus, with the blind slats in place, and with the first pulley rod partially rotated clockwise, showing the ladder strings inclined in closed position, as shown in FIG. 2B.
Figure 4C:
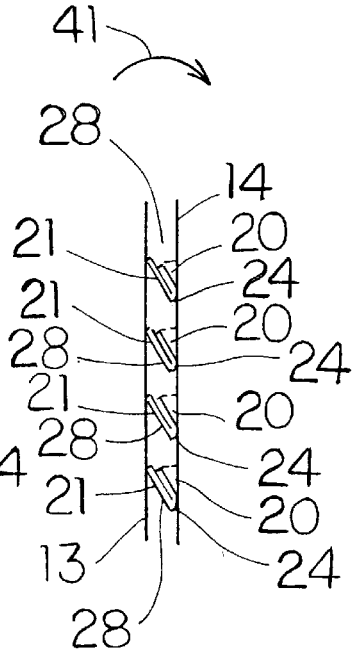
FIG. 4C is a partial detail view of a portion of the overlapping blind apparatus, with the blind slats in place, and with the first pulley rod further rotated clockwise, showing the ladder strings further inclined in closed positioned, as shown in FIG. 2C.
Figure 6A:
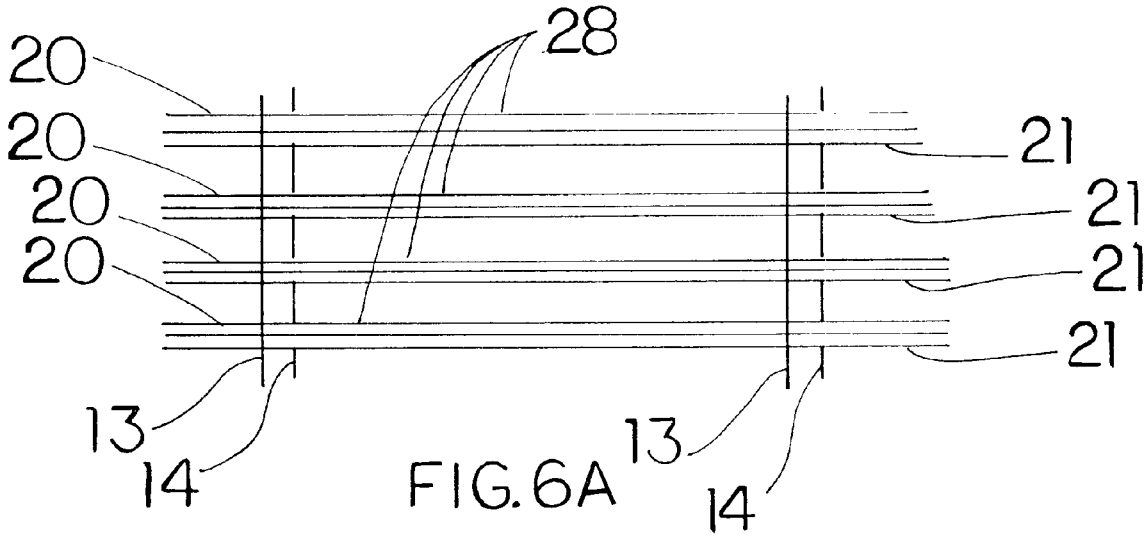
FIG. 6A is an elevational view of a portion of the horizontal overlapping blind apparatus, with the blind slats in place, showing the overlapping blinds in the closed position shown in FIG. 4A.
Figure 6B:
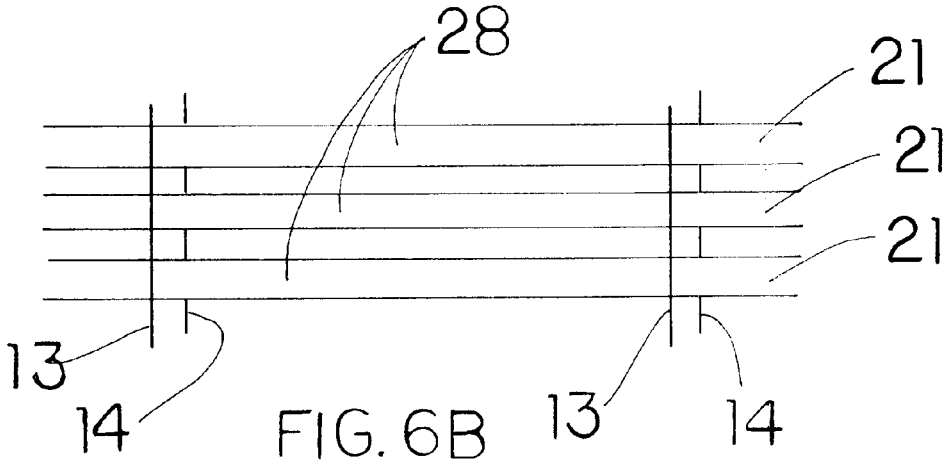
FIG. 6B is an elevational view of a portion of the horizontal overlapping blind apparatus, with the blind slats in place, and with the first pulley rod partially rotated clockwise, showing the ladder strings in closed position and partially raised, as shown in FIG. 4B.
Figure 6C:
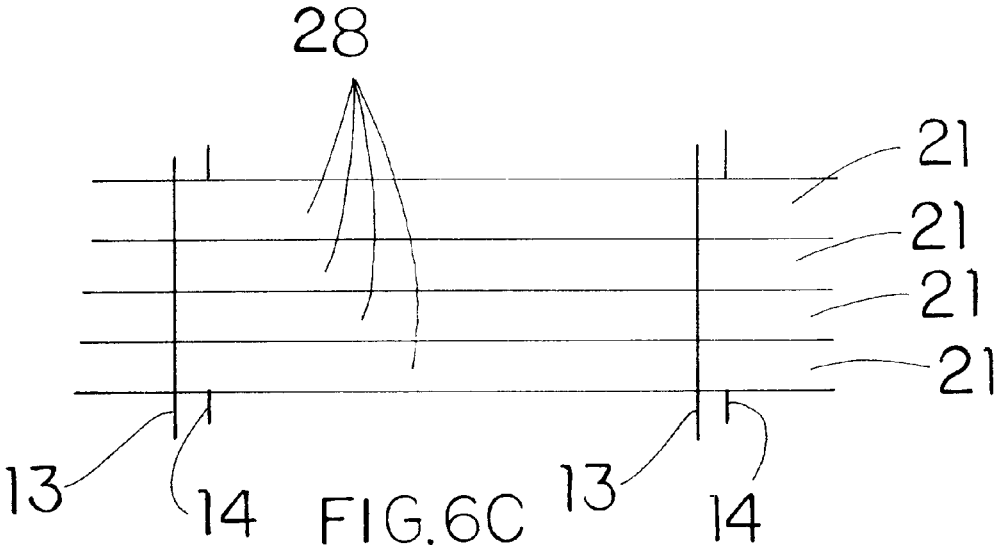
FIG. 6C is an elevational view of a portion of the horizontal overlapping blind apparatus, with the blind slats in place, and with the first pulley rod further rotated clockwise, showing the ladder strings in closed position, as shown in FIG. 4C.
Figure 8C:
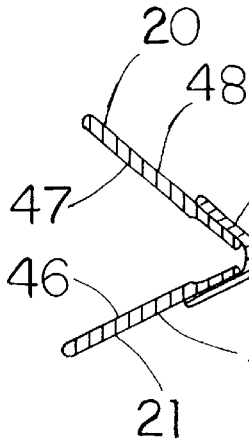
FIG. 8C is a cross-sectional view of another embodiment for a hinged slat.

However, when the first pulley rod 12 is moved in a clockwise position in the direction of arrow 41, the first and second slats 20, 21 partially tilt, but remain in a substantially closed, parallel alignment, as shown in FIGS. 4B and 6B. When the first pulley rod 12 is further moved clockwise in the direction of arrow 41, the first and second slats 20, 21 tilt further, but remain in a substantially closed, parallel alignment, as shown in FIGS. 4C and 6C.

Thus, when the first pulley rod 12 is moved in a clockwise direction as shown by arrow 41, the overlapping blind apparatus 10 acts in a manner similar to conventional mini-blinds. However, the upper and lower slats 20, 21 serve to increase the opaqueness of the overlapping blinds, due to the double thickness of the slats 20, 21 as shown in FIGS. 4B–4C and FIGS. 6B–6C.

When the first pulley rod 12 is moved in a counter-clockwise direction, as shown by arrow 40, the overlapping blind apparatus 10 provides an entirely different appearance, wherein the hinged first and second slats 20, 21 open in a V-shape about the hinge means 22 at the hinged end 24, as shown in FIGS. 3B–3C and FIGS. 5B–5C.

Figure 8A:
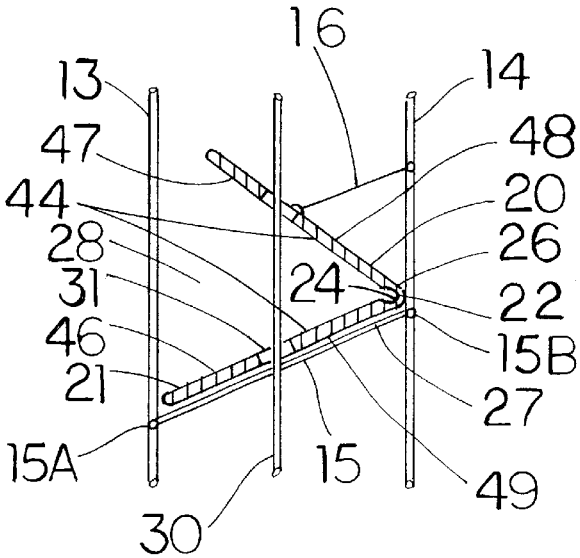
FIG. 8A is a cross-sectional view of one hinged slat partially rotated in a counter-clockwise direction, showing a central lifting string extending through an aperture in the first and second slat.

Indicia 44, such as color, texture, patterns or designs may be incorporated onto the first and second slats 20, 21, as shown in FIG. 8A. This provides an attractive appearance, which changes the appearance of the first and second slats 20, 21, as they are selectively moved by the clockwise and counterclockwise movement of the first pulley rod 12. For example, if the inner sides 46, 47 of the first and second slats 20, 21 contain indicia 44, it would be easily seen from inside the room, as the overlapping blind apparatus 10 is positioned as shown in FIGS. 3B–3C and 5B–5C. However, it would not be visible from inside the room, when the overlapping blind apparatus 10 was positioned as shown in FIGS. 4B–4C and 6B–6C.

Figure 8B:
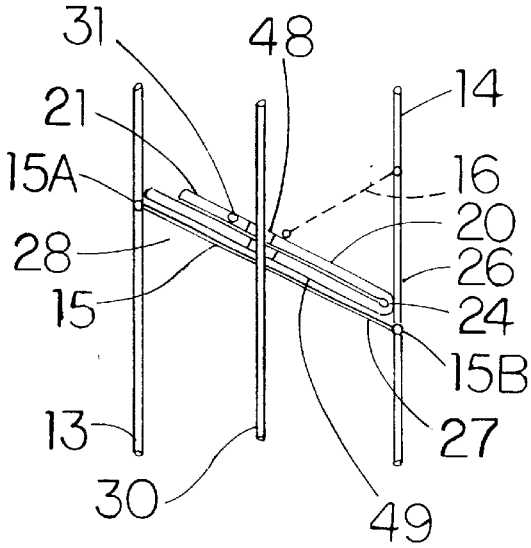
FIG. 8B is a cross-sectional view of one hinged slat partially rotated in a clockwise direction, showing a central lifting string extending through an aperture in the first and second slats.
Figure 9A:
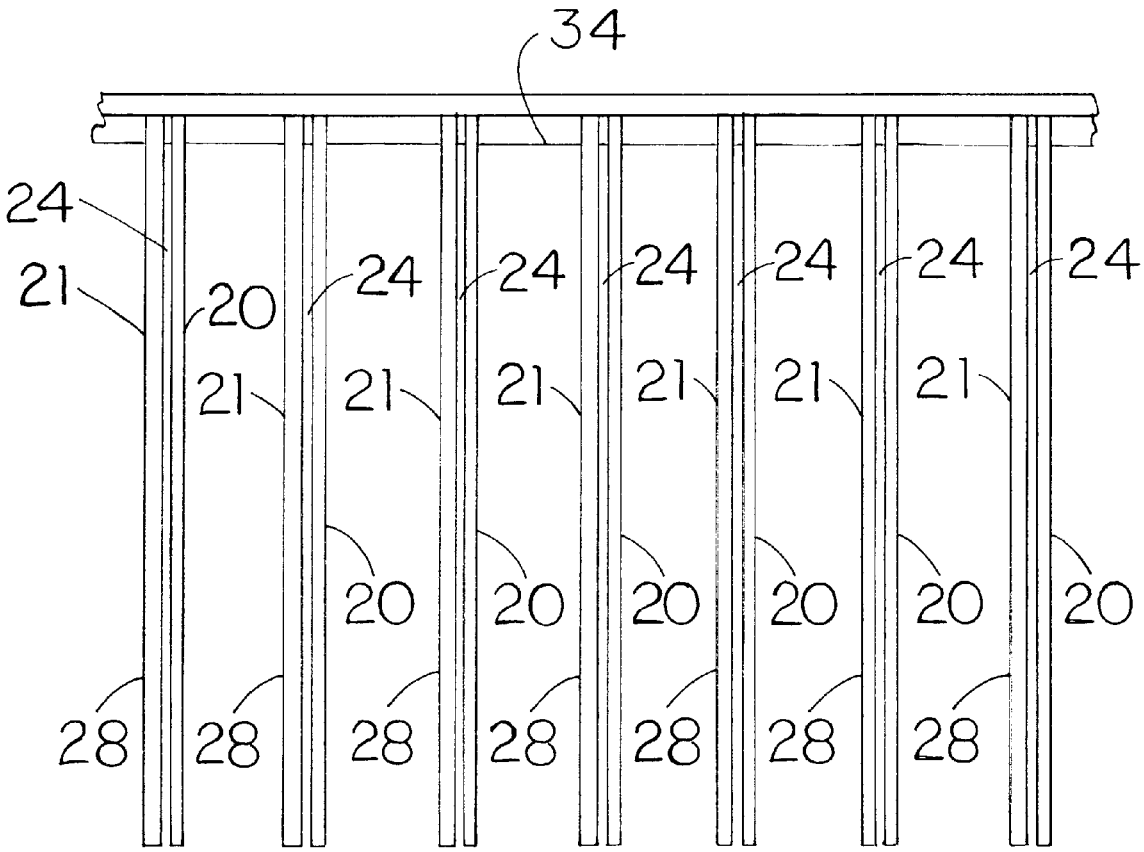
FIG. 9A is a partial front elevation view of a vertical overlapping blind apparatus showing a support cord positioned through apertures in each slat to support the slats in vertical alignment.
Figure 9B:
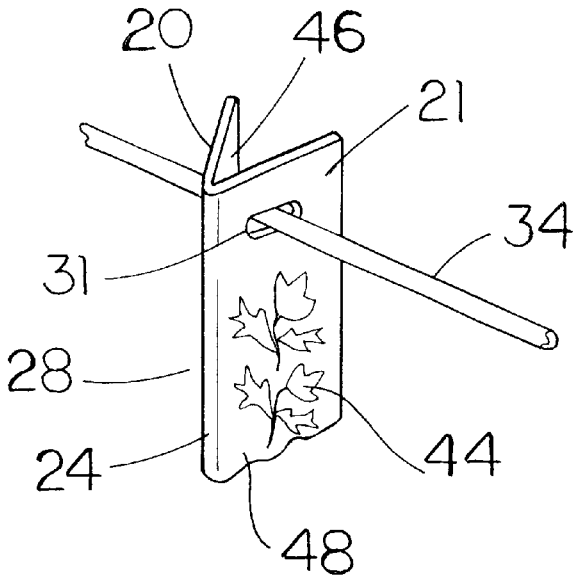
FIG. 9B is a partial side view of the slats of FIG. 9A, showing the support cord extending through the aperture provided.

Conversely, indicia 44 may be placed on the outer surfaces 48, 49 of the first and second slats 20, 21, as shown in FIGS. 8B and 9B. The indicia 44 is not visible from inside the room when the overlapping blind apparatus 10 is positioned as shown in FIGS. 3A–3C and FIGS. 5A–5C, but would become visible from inside the room, when the first and second slats were moved into the positions shown in FIGS. 4B–4C and 6B–6C.

In the fully extended position shown in FIG. 3C and FIG. 5C, the second slat 21 of each set of overlapping blinds 28 substantially overlaps the first slat 20 of the next adjacent set of overlapping blinds 28. This results in improved light blockage, which is advantageous for individuals who prefer a darker sleeping environment. This positions the first and second slats 20, 21 at their most extended position. In this position, the first slat 20 rests against the bottom portion of the next adjacent, second slat 21. This overlap effectively blocks light leakage through the first and second slats 20, 21 from above and below or to either side of the overlapping blind apparatus 10. Moreover, the overlapping blind apparatus 10 completely seals the window from view, so that people cannot look into a room through the plurality of overlapping first and second slats 20, 21.

Figure 7:
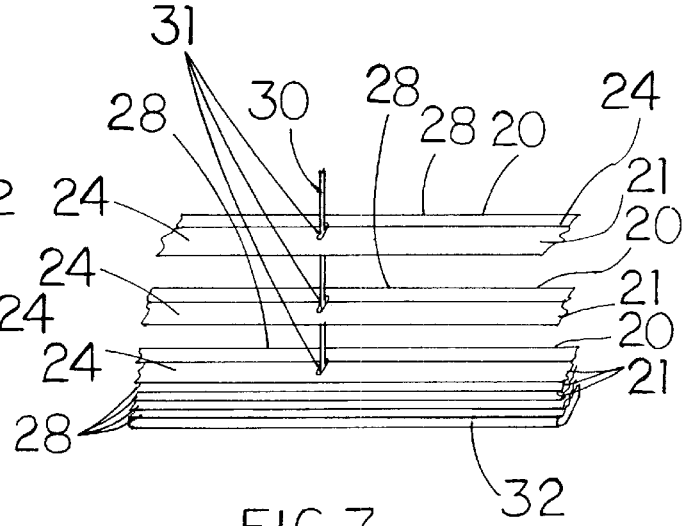
FIG. 7 is an elevational view of a portion of the horizontal overlapping blind apparatus, with the blind slats in place, showing a central lifting string partially raised.

When the first and second slats 20, 21 are mounted horizontally, as shown in FIG. 7, a lifting string 30 may be adapted to raise or lower the overlapping blind apparatus 10 disclosed herein.

The lifting string 30 will not hamper the operation of the horizontal overlapping blind apparatus 10, because the first slats 20 in one embodiment are narrower than the second slats 21, and an elongated aperture 31 is provided in each of the first and second slats 20, 21. The central lifting string 30 passes through the elongated apertures 31 in each of the first and second overlapping slats 20, 21, as shown in FIG. 8A and FIG. 8B. The lifting string 30 allows the user to raise or lower the bottom portion 32 of the overlapping blind apparatus 10 in a conventional manner, as shown in FIG. 7. The lifting string 30 in one embodiment is centrally positioned in spaced relation between the sets of first and second ladder strings 13, 14.

When the first and second slats 20, 21 are mounted vertically, as shown in FIG. 9, a horizontal rod or cord 34 extends through elongated apertures 31 aligned in each of the plurality of first and second slats 20, 21. The horizontal rod or cord 34 supports the first and second slats 20, 21 in an aligned, vertical position between first and second spaced, vertically aligned pulley rods 12, 18.

The vertical actuation of the first and second vertical pulley rods 12, 18 biases the first and second slats 20, 21 in the same manner as the horizontal actuation of the first and second horizontal pulley rods 12, 18 noted above. Thus, this apparatus is adapted for mounting in either vertical or horizontal positions, as shown in FIGS. 1 through 11.

Figure 10A:
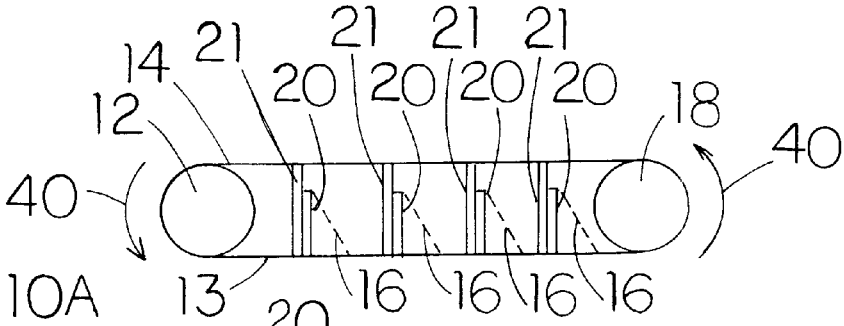
FIG. 10A is a top view of the vertical overlapping blind apparatus of FIG. 9, showing the overlapping blinds in a substantially closed, side-by-side vertical position.
Figure 10B:
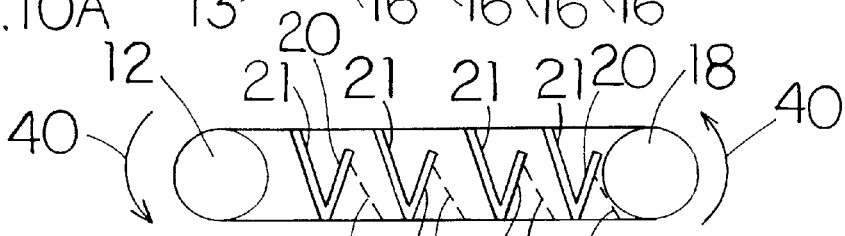
FIG. 10B is a top view of a portion of the vertical overlapping blind apparatus of FIG. 9, with the first pulley rod partially rotated counter-clockwise, showing the ladder strings partially opened position.
Figure 10C:
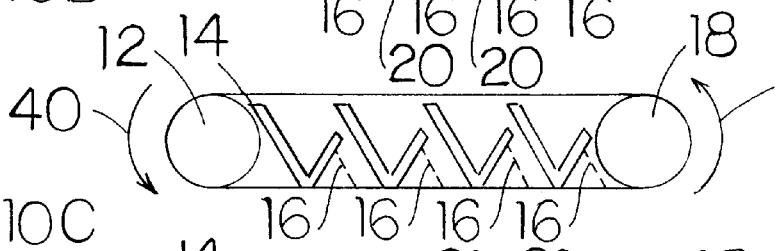
FIG. 10C is a top view of a portion of the vertical overlapping blind apparatus of FIG. 9, with the blind slats substantially opened, and with the first pulley rod further rotated counter-clockwise.

FIGS. 10A through 10C show the vertical blind apparatus 10, wherein the first and second slats 20, 21 are selectively positioned by counter clockwise 40 rotation of the first and second pulley rods 12, 18.

Figure 11A:
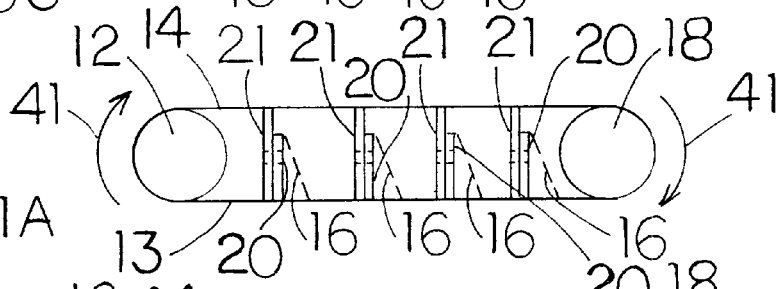
FIG. 11A is a top view of a portion of the vertical overlapping blind apparatus of FIG. 9, with the blind slats rotated clockwise, with the overlapping blinds in a substantially closed, side-by-side vertical position.
Figure 11B:
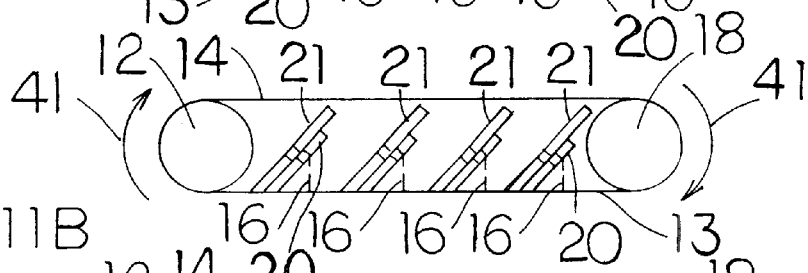
FIG. 11B is a top view of a portion of the vertical overlapping blind apparatus of FIG. 9, with the first pulley rod partially rotated clockwise, showing the overlapping blinds inclined in a substantially closed, side by side vertical position.
Figure 11C:
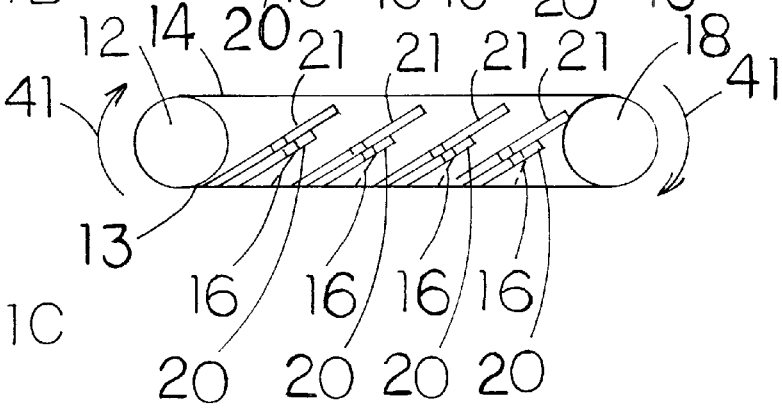
FIG. 11C is a top view of a portion of the vertical overlapping blind apparatus of FIG. 9, with the first pulley rod further rotated clockwise, showing the overlapping blinds further inclined in a substantially closed, side by side vertical position.

FIGS. 11A through 11C show the vertical blind apparatus 10 wherein the first and second slats 20, 21 are selectively positioned by clockwise rotation 41 of the first and second pulley rods 12, 18. Note that in FIG. 10, counter-clockwise 40 rotation results in a V-shaped separation of the first and second slats 20, 21, whereas clockwise 41 rotation of the first and second pulley rods 12, 18 result in adjacent inclined alignment of the first and second slats 20, 21.

Thus, while a preferred embodiment of the invention has been disclosed herein, it will be apparent to one skilled in this art that various changes and modifications may be made to this invention without departing from the spirit or scope of this invention. It is therefore to be understood that all such modifications, variations and equivalents of this invention are intended to be encompassed within the scope of the following claims.

What is claimed is:

1. An overlapping, movable blind apparatus for covering a window, which comprises: a) a pulley rod rotatably secured adjacent to the top side of said window; b) a first ladder string extending from a front side of said pulley rod, said first ladder string selectively biased clockwise and counter-clockwise by selective rotation of said pulley rod; c) a second ladder string depending from a back side of said pulley rod, said second ladder string biased by rotation of said pulley rod in a direction opposite to movement of said first ladder string; d) a plurality of bridging strings disposed in spaced, parallel relation between the first ladder string and the second ladder string, said bridging strings movable in parallel aligned relation; e) a plurality of first slats, each first slat positioned in spaced relation between the first ladder string and the second ladder string, each first slat having a first end and a second end, a first outer surface and a second inner surface extending between said first end and said second end; f) a plurality of second slats, each second slat positioned in spaced relation between the first ladder string and the second ladder string, each second slat having a first end and a second end, a first outer surface and a second inner surface extending between said first and said second end of said second slats; and the first and second slats joined together at adjacent ends by a hinge means; g) a plurality of louver strings, each louver string connected at a first end thereof to said first slat and at a second end thereof to said second ladder string; and the first ladder string is selectively biased by said pulley rod in a clockwise direction to incline adjacent first and second slats into spaced, parallel closed positions, with the first slat resting on an adjacent second slat and the second slat adjacent to a respective bridging string; and the first ladder string is selectively biased by said pulley rod in a counter-clockwise direction to selectively bias each of the plurality of slats into an open, V-shaped position about the hinge means.

2. The movable blind apparatus of claim 1, wherein the first slats are narrower in width than the second slats, and an elongated aperture is aligned in each of the first and second slats.

3. The movable blind apparatus of claim 2, wherein the first and second slats are positioned horizontally, and there are at least two sets of first and second ladder strings positioned in spaced relation along the pulley rod, and at least one central lifting string is positioned through said aligned, elongated apertures in the plurality of first and second slats.

4. The movable blind apparatus of claim 1, wherein indicia is placed upon the inner surface of the first and second slats to provide a combined image when the slats are moved to said open position about said hinge means.

5. The movable blind apparatus of claim 1, wherein the hinge means comprises an inline crease along the length of a single large slat that is folded over on itself along said crease to form said first slat and said second slat, said incline crease providing flexible movement of said first slat and said second slat between a V-shaped open position and a parallel closed position.

6. The movable blind apparatus of claim 1, wherein the hinge means is formed by securing a flexible sheet material to adjacent first and second slats, with the flexible sheet material forming a pivotal hinge portion therebetween.

7. The movable blind apparatus of claim 1, wherein the width of the first slats are sized to overlap adjacent second slats when the slats are fully opened about the hinge means, to block sunlight from passing between the slats when the movable blind apparatus is placed in the fully opened position.

8. The movable blind apparatus of claim 1, wherein the slats are made of material selected from: plastic, wood, fiberglass, fabric, and metal.

9. The movable blind apparatus of claim 1, wherein the bridging strings are spaced substantially equally apart, a distance selected to be from about three quarters of an inch to about four inches apart, and the width of each of the first and second slat portions are more than one half the distance between the bridging strings.

10. An overlapping, movable blind apparatus for covering a window, which comprises: a) a pulley rod rotatably secured above said window; b) a first ladder string depending from a front side of said pulley rod, said first ladder string selectively biased clockwise and counter-clockwise by rotation of said pulley rod; c) a second ladder string depending from a back side of said pulley rod, said second ladder string biased by rotation of said pulley rod in a direction opposite to movement of said first ladder string; d) a plurality of bridging strings disposed in spaced, parallel relation between the first ladder string and the second ladder string, said bridging strings movable in parallel aligned relation; e) a plurality of first slats, each first slat positioned in spaced relation between the first ladder string and the second ladder string, each first slat having a first end and a second end, a first outer surface and a second inner surface extending between said first end and said second end; f) a plurality of second slats, each second slat positioned in spaced relation between the first ladder string and the second ladder string, each second slat having a first end and a second end, a first outer surface and a second inner surface extending between said first and said second end of said second slats; and the first and second slats are joined together at adjacent second ends by a hinge means; g) a plurality of louver strings, each louver string connected at a first end thereof to said first slat and at a second end thereof to said second ladder string; and the first ladder string is selectively biased by said pulley rod in a clockwise direction to incline adjacent first and second slats into spaced, parallel closed positions, with the first slat resting on an adjacent second slat and the second slat adjacent to a respective bridging string; and the first ladder string is selectively biased by said pulley rod in a counter-clockwise direction to selectively bias each of the plurality of slats into an open, V-shaped position about the hinge means.

11. The movable blind apparatus of claim 10, wherein indicia is placed upon the inner surface of selected first and second slats to provide a combined image when the slats are moved to said open position about said hinge means, and wherein the indicia is not visible when the first slat is positioned in parallel alignment with the second slat.

12. The movable blind apparatus of claim 10, wherein the hinge means comprises an inline crease along the length of a single large slat that is folded over on itself along said crease to form said first slat and said second slat, said incline crease providing flexible movement of said first slat and said second slat between a V-shaped open position and a parallel closed position.

13. The movable blind apparatus of claim 10, wherein the hinge means is formed by securing a flexible sheet material to adjacent first and second slats, with the flexible sheet material forming a pivotal hinge portion therebetween.

14. The movable blind apparatus of claim 10, wherein the width of the first slats are sized to overlap adjacent second slats when the slats are fully opened about the hinge means, to block sunlight from passing between the slats when the movable blind apparatus is placed in the fully opened position.

15. The movable blind apparatus of claim 10, wherein the slats are made of material selected from the group consisting of: plastic, wood, fiberglass, fabric, and metal.

16. The movable blind apparatus of claim 10, wherein the bridging strings are spaced substantially equally apart, a distance selected to be from about three quarters of an inch to about four inches apart, and the width of each second slat is more than about one half the distance between the bridging strings.

17. An overlapping, movable blind apparatus for covering a window, which comprises: a) a horizontally disposed pulley rod rotatably secured above said window; b) a first ladder string depending from a front side of said pulley rod, said first ladder string selectively raised and lowered responsive to clockwise and counter-clockwise rotation of said pulley rod; c) a second ladder string depending from a back side of said pulley rod, said second ladder string raised and lowered by rotation of said pulley rod in a direction opposite to movement of said first ladder string; the first and second ladder strings forming a ladder string set, and at least two ladder string sets are spaced apart along the pulley rod; d) a plurality of bridging strings disposed in spaced, parallel relation between the first ladder string and the second ladder string, said bridging strings movable in parallel aligned relation; e) a plurality of slats, each slat positioned in spaced horizontal relation between the first ladder string and the second ladder string, each slat having an upper slat portion and a lower slat portion, the upper slat portion and the lower slat portion joined together by a hinge means, the width of the upper slat portions being sized to overlap adjacent lower slat portions when the slats are fully opened about the hinge means, to block sunlight from passing between the slats when the movable blind apparatus is placed in the fully opened position; f) a plurality of upper louver strings, each upper louver string connected at a first end to said upper slat portion of a selected slat, and at a second end to said second ladder string; g) a central lifting string positioned in spaced relation between the ladder string sets; the central lifting string extending through a vertically aligned aperture in each said first and second slat portions, said central lifting string positioned to raise and lower the overlapping blinds in relation to said pulley rod, and wherein the first ladder string is selectively raised to bias each of the plurality of slats into spaced, parallel closed positions, with the upper slat portion resting on the lower slat portion and the lower slat portion resting on a respective bridging string; and the first ladder string is selectively lowered to bias each of the plurality of slats into an open position about the hinge means to a position where the upper slat portion abuts the lower slat portion of the adjacent slat, and the lower slat portion is lowered to abut the upper slat portion of the next adjacent slat.

18. The movable blind apparatus of claim 17, wherein indicia is placed upon selected upper and lower slat portions to provide a combined image when the slats are moved to said open position about said hinge means.

19. The movable blind apparatus of claim 17, wherein the bridging strings are spaced substantially equally apart, a distance selected to be from about three quarters of an inch to about four inches apart, and the width of each of the first and second slat portions is more than about one half the distance between the bridging strings.

* * * * *

UNITED STATES PATENT AND TRADEMARK OFFICE

CERTIFICATE OF CORRECTION

PATENT NO. : 6,644,377 B1
DATED : November 11, 2003
INVENTOR(S) : Philip Lewis

It is certified that error appears in the above-identified patent and that said Letters Patent is hereby corrected as shown below:

Title page,
Item [75], Inventor, "Lewis; Phillip" should read -- Lewis; Philip --.

Signed and Sealed this

Seventeenth Day of August, 2004

JON W. DUDAS
*Acting Director of the United States Patent and Trademark Office*